United States Patent [19]

Yamabe et al.

[11] 4,436,772

[45] Mar. 13, 1984

[54] ANTICORROSIVE COATING PROCESS

[75] Inventors: Masaaki Yamabe, Machida; Hiromichi Higaki, Yokohama; Toshio Shinohara, Yokohama; Hiroyuki Tanabe, Yokohama; Shunsuke Nakayama, Yokohama, all of Japan

[73] Assignees: Dai Nippon Toryo Co., Ltd., Osaka; Asahi Glass Company, Ltd., Tokyo, both of Japan

[21] Appl. No.: 460,380

[22] Filed: Jan. 24, 1983

[30] Foreign Application Priority Data

Feb. 5, 1982 [JP] Japan ..... 57-16361

[51] Int. Cl.[3] ..... B05D 3/02

[52] U.S. Cl. ..... 427/379; 427/385.5; 427/386; 427/388.1

[58] Field of Search ..... 427/379, 385.5, 386, 427/388.1

[56] References Cited

U.S. PATENT DOCUMENTS 4,345,057 8/1982 Yamabe et al. ..... 526/247

*Primary Examiner*—Bernard D. Pianalto

*Attorney, Agent, or Firm*—Oblon, Fisher, Spivak, McClelland & Maier

[57] ABSTRACT

An anticorrosive coating process comprises:

(i) a step of applying on a substrate a zinc-rich paint or an epoxy resin primer coating, followed by air-drying, (ii) a step of applying thereon an intermediate synthetic resin coating, followed by air-drying, and (iii) a step of applying thereon a top coating comprising (a) a fluorine-containing copolymer composed of from 40 to 60 molar % of a fluoroolefin, from 5 to 45 molar % of cyclohexylvinyl ether, from 5 to 45 molar % of an alkylvinyl ether, from 3 to 15 molar % of a hydroxyalkylvinyl ether and from 0 to 30 molar % of other comonomer and (b) a polyisocyanate, followed by air-drying.

6 Claims, No Drawings

ANTICORROSIVE COATING PROCESS

The present invention relates to an anticorrosive coating process for forming on a substrate a coating layer which has superior ahdesion and which provides good weatherability and corrosion preventing effect for a long period of time.

For long time in the past, oil-type anticorrosive paints have predominantly been used for the prevention of the corrosion of steel structures. In a relatively mild corrosive environment, oil-type anticorrosive paints exhibit good anticorrosive performance. They have a wide range of applicability and are relatively inexpensive, and accordingly they are still used in various fields.

On the other hand, with the progress of polymer chemistry, various synthetic resins have been developed and some of them have been used for anticorrosive coatings. For instance, there have been some developments such that an oil-type anticorrosive paint which is inferior in the weatherability and requires a relatively long time for drying, is partially modified with an alkyd resin, or an oil-type ready mixed paint has been replaced by a long-oil alkyd resin paint. Nowadays, a variety of synthetic resin coatings are available for use.

Further, as a shop primer to protect an iron substrate by its electrochemical action, a zinc-rich paint containing a great amount of zinc dust in a vehicle, has been developed and it is used in combination with a synthetic resin coating.

Particularly, in recent years it has become common to use a combination of a zinc-rich paint or metal spraying with a high-build synthetic resin coating to provide a highly effective heavy duty anticorrosive coating system having long durability in a severe corrosive environment. For the anticorrosive coating of steel structures as mentioned above, there are available a general purpose coating system in which an oil-type primer or zinc-rich primer and a synthetic resin coating are used and a heavy duty anticorrosive coating system in which a metal spraying or high-build zinc-rich primer and a high-build synthetic resin coating are used. They are optionally selected for use to meet the particular conditions such as the corrosive environment in which the steel structures are installed or the conditions for the installation of the structures.

However, with such conventional coating systems, the durability of the coatinngs is rather limited, and partial or entire recoating used to be required every three to five years in the case of the general purpose coating system comprising an oil-type primer or zinc-rich primer and a synthetic resin coating and every five to ten years even in the case of the heavy duty anticorrosive coating system comprising a high-build zinc-rich primer and a high-build synthetic resin coating, because of the chalking caused by the degradation of the resin or pigment, a deterioration of the gloss due to the discoloration, or the formation of rusts, blisters or peeling caused by the penetration of corrosive substances such as water, oxygen or chlorine ions, as they are exposed to the ultra-violet rays and rain water.

On the other hand, reflecting the recent trend for larger steel structures such as bridges or tanks, there is an increasing tendency for an increase of the costs and the number of process steps required for the recoating. Accordingly, there is a strong demand for a coating system which provides effective corrosion prevention and weatherability for a long period of time, that is, a coating system having a long cycle for the recoating.

In a corrosion reaction of the coated steel structure which takes place in a neutral environment as in the atmosphere, the cathode reaction for corrosion is usually governed by the oxygen reduction reaction and accordingly the oxygen permeability of the coating layer becomes critical.

When it is taken into accounts that the oxygen reduction reaction governs the cathode reaction for corrosion, the limiting current density ($I_{max}$) corresponding to the corrosion rate of the steel beneath the coating layer is represented by the following equations.

$$I_{max} = M_{max} \cdot n \cdot F$$
$$= K \cdot Co \cdot nF/d$$

where:

$M_{max}$: amount of dissolved oxygen for diffusion,
K: diffusion coefficient of oxygen,
d: the thickness of the diffusion layer (thickness of the coating layer),
n: reactive electron number,
F: Faraday's constant,
Co: oxygen concentration.

Accordingly, in order to reduce the corrosion rate of the steel beneath the coating layer, it is necessary either to substantially increase the thickness of the coating layer or to reduce the oxygen permeability, that is, the amount of the dissolved oxygen for diffusion or the diffusion coefficient of oxygen if the thickness of the coating layer is maintained to be constant. Further, it is necessary to prevent the reduction of the thickness of the coating layer due to e.g. chalking, for a long period of time. If the oxygen permeability of the coating layer is reduced to a half, the corrosion rate of the steel beneath the coating layer will likewise be reduced to one half. Thus, the oxygen permeability of the coating layer is critical to the lasting corrosion prevention of the coated steel structures.

However, an alkyd resin or chlorinated rubber used as a vehicle in the top coating as mentioned above, has a relatively great oxygen permeability, whereby the corrosion of the steel beneath the coating layer is facilitated and the coating defects are likely to be led. Further, in the abovementioned top coating, the resin and pigment are likely to be deteriorated by the exposure to e.g. ultra-violet ray, and discoloration, chalking or the formation of cracks is likely to take place, thus leading to a decrease of the gloss or color fading. Thus, long lasting corrosion prevention or weatherability can not thereby be expected.

Further, a silicone resin has recently been developed as a resin having good weatherability and its application as a top coating has been attempted.

However, air-drying type silicone-alkyd resins or silicone-acrylic resins have a relatively great oxygen permeability and do not provide adequate corrosion prevention for the steel beneath the coating layer although they may improve the weatherability of the top coating. Further, the top coating thereby obtained tends to be soft and susceptible to staining and scratching. At the same time, it has an additional drawback that the resin undergoes whitening. Although the abovementioned resin undergoes no degradation and maintains the initial gloss for a long period of time, the pigment in the surface layer of the coating tends to fade and thus undergoes substantial color change, and after all, such a top coating is inadequate for use for a long period of time.

Furthermore, as time passes since the application of a coating, crosslinking, etc. proceed within the coating layer and at the time of recoating, the old coating layer does not provide adequate adhesion with the recoated layer and there used to be a difficulty that inter-layer peeling is likely to occur. Such a difficulty used to be observed especially when a top coating of a urethane resin type, an epoxy resin type, a tar-modified epoxy type, etc. is recoated.

Accordingly, it is an object of the present invention to overcome such various difficulties in the conventional coatings and to provide an anticorrosive coating process which is capable of providing a coating system having a long lasting corrosion preventing property, long lasting weatherability, good adhesion and superior recoatability.

Namely, the present invention provides an anticorrosive coating process which comprises:

(i) a step of applying on a substrate a zinc-rich paint or an epoxy resin primer coating, followed by air-drying, (ii) a step of applying thereon an intermediate synthetic resin coating, followed by air-drying, and (iii) a step of applying thereon a top coating comprising (a) a fluorine-containing copolymer composed of from 40 to 60 molar % of a fluoroolefin, from 5 to 45 molar % of cyclohexylvinyl ether, from 5 to 45 molar % of an alkylvinyl ether, from 3 to 15 molar % of a hydroxyalkylvinyl ether and from 0 to 30 molar % of other comonomer and (b) a polyisocyanate, followed by air-drying.

Now, the present invention will be described in detail with reference to the preferred embodiments.

The zinc-rich paint to be used as a primer in the anticorrosive coating process of the present invention, is an organic-type or inorganic-type coating containing from 75 to 95% by weight, preferably from 80 to 90% by weight, of zinc dust in the dried coating layer.

As the vehicle of the organic-type zinc-rich paint, there may be mentioned a combination of an epoxy resin with a polyamide resin, a chlorinated rubber, a polystyrene resin or a silicone resin. As the vehicle for the inorganic-type zinc-rich paint, there may be mentioned ethylsilicate, sodium silicate, lithium silicate, potassium silicate or ammonium silicate. Particularly preferred vehicles for the purpose of the present invention are a combination of an epoxy resin with a polyamide resin, ethyl silicate, pottasium silicate and lithium silicate.

The epoxy resin primer coating to be used as a primer in the anticorrosive coating process of the present invention, is a composition comprising an epoxy resin, a hardener and, optionally, various pigments, solvents or other additives.

As the epoxy resin, there may be mentioned a resin having at least two epoxy groups in its molecule, for instance, (1) a resin synthesized by the reaction of bisphenol A with epichlorohydrin or methylepichlorohydrin, such as the ones known by the trade names Epikote #827, #828, #1001, #1004, #1007 and #1009, manufactured by Yuka Shell Epoxy Co., the ones known by the trade names ERL #2772 and #2774 and EKR 2002, manufactured by Union Carbide Co., the ones known by the trade names Araldite GY-#250, #260, #280, #6071, #6084 and #6099, manufactured by Ciba Geigy Corp., the ones known by the trade names DER #330, #331, #332, #661 and #664, manufactured by Asahi Chemical Industry Co., Ltd. or the ones known by the trade names Epiclon #800, #1000 and #4000, manufactured by Dainippon Ink & Chemicals Inc., (2) a resin synthesized by the reaction of a glycol with epichlorohydrin or methylepichlorohydrin, such as the one known by the trade name DER #736 manufactured by Dow Chemical Co., (3) a resin obtained by reacting a phenol with formaldehyde in the presence of an acidic or alkaline catalyst to obtain a novolak or resol and reacting thus obtained novolak or resol with epichlorohydrin or methylepichlorohydrin, such as the ones known by the trade names DEN #431, #438 and #448, manufactured by Dow Chemical Co. or the ones known by the trade names ECN #1235, #1273, #1280 and #1290, manufactured by Ciba Geigy Corp., (4) a resin synthesized by oxidizing a double bond within a molecule, such as the ones known by the trade names Unox #201, #206, #207, #221 and #289, manufactured by Union Carbide Co., the ones known by the trade names Araldite GY #175 and #176, manufactured by Ciba Geigy Corp. or the ones known by the trade names Oxilone #2001 and #2002, manufactured by FMC Corp. (5) a resin obtained by reacting a halogenated phenol with epichlorohydrin or methylepichlorohydrin, such as the ones known by the trade names DER #511, #542 and #580, manufactured by Dow Chemical Co. or the ones known by the trade names Araldite #8011 and #8047, manufactured by Ciga Geigy Corp., (6) a resin obtained by reacting epichlorohydrin or methylepichlorohydrin with an addition product of a phenol with ethylene oxide or propylene oxide, such as the one known by the trade names EP #4000 and #4001, manufactured by Asahi Electro-Chemical Co. Ltd., (7) a resin obtained by reacting a carboxylic acid with epichlorohydrin or methylepichlorohydrin, such as the ones known by the trade names AK #737 and #838, manufactured by Nippon Kayaku Kabushiki Kaisha, the ones known by the trade names Showdine #508, #540 and #550, manufactured by Showa Denko K.K. or the ones known by the trade names Epiclon #200, #300, #400 and #500, manufactured by Dainippon Ink & Chemicals Inc. These resins may be used alone or in combination as a mixture.

It should be understood that other epoxy compounds and their derivatives fall within the scope of the present invention so long as they are readily inferred from the abovementioned compositions. For instance, as such compounds, there may be mentioned polyol-type epoxy resins, cyclic epoxy resins and halogen-containing epoxy resins. Further, in order to improve the workability, the coating properties or the coating condition, it is possible to incorporate a monoepoxy compound having only one epoxy group to the abovementioned epoxy resin in an amount of upto 20% by weight relative to the above mentioned epoxy resin. As such an additional monoepoxy compound, there may be mentioned, for instance, allyl glycidyl ether, 1-ethylhexylglycidyl ether, methylglycidyl ether, butylglycidyl ether, phenylglycidyl ether, styreneoxide, cyclohexeneoxide and epichlorohydrin. Further, in addition to the above, there may be incorporated a petroleum resin, a melamine resin, a urea resin, a phenol resin, a hydrocarbon resin (e.g. polybutadiene), an alkyd resin, a polyester resin, maleic oil, urethane oil, coal tar or asphalt.

As the hardener for the abovementioned epoxy resin, amino-type compound such as an amine adduct, a polyamine, a polyamine may be used alone or in combination as a mixture. For the crosslinking reaction with the abovementioned epoxy resin, these amino-type compounds must contain at least two nitrogen atoms per molecule and functional hydrogen atoms attached to the nitrogen atoms.

As the amino-type hardener to be used in the present invention, there may be mentioned commercially available polyamide resins such as those known by the trade names Tohmide Y-25, Y-245, Y-2400 and Y-2500, manufactured by Fuji Chemical Industry Co., Ltd., those known by the trade names Genamid 2000, Versamid 115 and 125, and DSX-1280, manufactured by Dai-Ichi General Co., Ltd., those known by the trade names Sunmide 320 and 330, manufactured by Sanwa Chemical Industry Co., Ltd., and those known by the trade names Epikure 3255 and 4255, manufactured by Yuka Shell Epoxy Co., Ltd.; amine adduct resins such as those known by the trade names Tohmide 238, Fujicure #202, and #5000, manufactured by Fuji Chemical Industry Co., Ltd., and those known by the trade names Adeka Hardener EH-212, EH-220, EH-240 and EH-531, manufactured by Asahi Electro-Chemical Co., Ltd.; heterocyclic diamine derivatives such as those known by the trade names Epomate B-002, C-002 and S-005, manufactured by Ajinomoto Co., Ltd.; and aliphatic polyamines such as those known by the trade names Sunmide T-100, D-100 and P-100, manufactured by Sanwa Chemical Industry Co., Ltd. These hardeners may be used alone or in combination as a mixture depending upon the particular purpose.

The amount of addition of the hardener to the epoxy resin is usually about the equivalent amount, i.e. within a range of from 0.7 to 1.3 equivalent per equivalent of the epoxy resin.

Further, a polyisocyanate may be used as a hardener for the abovementioned epoxy resin.

The polyisocyanate is a polyfunctional isocyanate having at least two isocyanate groups per molecule. For instance, there may be mentioned polyisocyanates such as ethylenediisocyanate, propylenediisocyanate, tetramethylenediisocyanate, hexamethylenediisocyanate, decamethylene-diisocyanate, m-phenylene-diisocyanate, p-phenylene-diisocyanate, 2,4-tolylene-diisocyanate, 2,6-tolylene-diisocyanate, 1,5-naphthylene-diisocyanate, 4,4',4''-triphenylmethane-triisocyanate, 4,4'-diphenylmethane-diisocyanate, 3,3'-dimethyl-4,4'-diphenylene-diisocyanate, m-xylylene-diisocyanate, p-xylylene-diisocyanate, isophoronediisocyanate and lysineisocyanate; polyisocyanates which are obtained by an addition reaction of the excess amount of the abovementioned isocyanate compounds with a low molecular weight polyol such as ethylene glycol, propylene glycol, 1,3-butylene glycol, neopentyl glycol, 2,2,4-trimethyl-1,3-pentanediol, hexamethylene glycol, cyclohexanedimethanol, trimethylolpropane, hexanetriol, glycerine or pentaerythritol; and burette structured polyisocyanates or alloplanate structured polyisocyanates. The mixing ratio of the abovementioned epoxy resin with the polyisocyanate is preferably within the range such that the hydroxy groups in the epoxy resin/the isocyanate groups in the polyisocyanate is from 1/1.3 to 1/0.5 (equivalent ratio).

Further, if necessary, it is possible to incorporate into the epoxy resin-type primer coating a corrosion preventive pigment, for instance, a pigment obtained by reacting an oxy acid such as chromic acid, phosphoric acid (including a polyphosphoric acid), boric acid, molybdic acid, phosphomolybdic acid, silicomolybdic acid, tungstic acid, phosphotungstic acid, silicotungstic acid or sulfuric acid with various metals, such as strontium chromate, calcium chromate, lead chromate, zinc chromate, zinc molybdate, calcium molybdate, potassium molybdate, zinc tungstate, calcium tungstate, magnesium tungstate, zinc phosphate, lead orthophosphate, lead pyrophosphate, lead metaphosphate, aluminium phosphate, tin orthophosphate, tin pyrophosphate, tin oxyphosphate, zinc tetraborate, zinc metaborate, lead metaborate, lead tetraborate, barium metaborate, lead (II) sulfate or lead (IV) sulfate; one or more lead compounds such as metal lead, lead suboxide, lead oxide, lead dioxide, trilead tetroxide, white lead, lead cyanamide, calcium plumbate, basic lead sulfate and basic lead chromate; a coloring pigment such as iron oxide, titanium dioxide, chrome yellow, carbon black, phthalocyanine blue and zinc oxide; and an extender pigment such as calcium carbonate, precipitated barium sulfate, calcium silicate, barium carbonate, talc, clay, mica or silica.

On the other hand, the intermediate synthetic resin coating to be used for the anticorrosive coating process of the present invention is preferably a coating obtained by mixing at least one synthetic resin selected from the group consisting of epoxy resins (including tar-modified epoxy resins and urethane-modified epoxy resins), vinyl resins (including tar-modified vinyl resins and acrylic resins), chlorinated rubber, polyurethane resins, unsaturated polyester resins and phenol resins, as a vehicle, with commonly used coloring pigments, extender pigments, precipitation preventing agents, dispersing agents, hardeners, hardening accelerators, diluents or solvents.

As the epoxy resin, there may be used any one of the above mentioned epoxy resins useful for the primer coating. The epoxy resin is used by mixing it with the abovementioned amino-type hardener or polyfunctional isocyanate hardener in a ratio within the abovementioned equivalent range.

A bituminous substance such as natural asphalt, asphaltite, asphalt base pyro-bitumen, tar, coal tar, artificial asphalt or pitch, may be incorporated into the epoxy resin to obtain a tar-modified epoxy resin coating.

The vinyl resin to be used of the present invention is a copolymer of one or more monomers such as vinyl chloride, vinylidene chloride, vinyl acetate, vinyl propionate, styrene, vinyl toluene, vinyl alcohol, acrylic acid, methacrylic acid, maleic anhydride, an alkyl acrylate or an alkyl methacrylate. There may be mentioned a vinyl chloride resin, a vinyl chloride-vinyl acetate copolymer resin or an acrylic resin. The abovementioned bituminous substance may be mixed with the vinyl resin to obtain a tar-modified vinyl resin coating.

The chlorinated rubber resin to be used for the present invention is a chlorinated product of natural rubber and it usually has a chlorine content of from 65 to 68%. The chlorinated rubber may be used as a mixture with rosin, a cumarone-indene resin, a phenol resin, a vinyl chloride resin, a petroleum resin, a nitrile rubber, a chloroprene rubber and an alkyd resin. Further, the chlorinated rubber may be used as a mixture with a plasticizer such as chlorinated paraffin, chlorinated diphenyl, dioctyl phthalate or tricresylphosphate.

Further, the polyurethane resin to be used for the present invention is a composition which comprises, as the major component, a compound having at least two active hydrogen atoms in its molecule, such as a polyester polyol obtained from a polybasic acid and a polyhydric alcohol, a polyether polyol, a polyoxyalkylene glycol or an acrylpolyol and, as a hardener, the abovementioned polyisocyanate having at least two isocyanate groups in its molecule.

The unsaturated polyester resin to be used for the present invention is an ester compound obtainable from an unsaturated polycarboxylic acid or its acid anhydride, saturated polycarboxylic acid or its acid anhydried and polyhydric alcohol, or an ester compound obtainable by reacting an epoxy resin with an $\alpha,\beta$-monoethylenic unsaturated monocarboxylic acid. These resins usually contain from about 10 to 50% by weight of an $\alpha,\beta$-monoethylenic unsaturated monomer such as styrene or methylmethacrylate, which has a strong dissolving power, and they are commercially available as unsaturated polyester resins.

As the saturated or unsaturated polycarboxylic acid or its acid anhydride to be used for the production of the abovementioned unsaturated polyester resin, there may be mentioned maleic acid, fumaric acid, itaconic acid, citraconic acid, mesaconic acid, maleic anhydride, phthalic anhydride, isophthalic acid, terephthalic acid, hexahydrophthalic anhydride, tetrahydrophthalic anhydride, tetrabromophthalic anhydride, tetrachlorophthalic anhydride, chlorendic acid, 3,6-endmethylenetetrahydrophthalic anhydride, trimellitic acid anhydride, pyromellitic acid anhydride, methylnadic acid, succinic acid, adipic acid, sebacic acid, azelaic acid, anthracene-maleic anhydride adduct or a rosin-maleic anhydride adduct. These compounds may be used alone or in combination as a mixture.

As the polyhydric alcohol to be used for the production of the abovementioned unsaturated polyester resin, there may be mentioned ethylene glycol, diethylene glycol, triethylene glycol, propylene glycol, dipropylene glycol, butanediol-1,3, butanediol-1,4, butanediol-2,3, pentanediol-1,5, hexanediol-1,6, neopenthyl glycol, 1,1,4-trimethylpentandiol-1,3, hydrogenated bisphenol A, 2,2-di(4-hydroxy-propoxyphenyl)propane, glycerine, pentaerythritol diallyl ether, trimethyleneglycol, 2-ethyl-1,3-hexanediol, trimethylol propane, cyclohexanedimethanol-1,4, 2,2,4-tetramethylcyclobutanediol-1,3, 1,4-bis(2-oxyethoxy)benzene, or 2,2,4,4-tetramethylcychlobutanediol-1,3. These alcohols may be used alone or in combination as a mixture.

Further, the epoxy resin to be used for the reaction with the $\alpha,\beta$-monoethylenic unsaturated monocarboxylic acid may be any one of the abovementioned epoxy resins having at least two epoxy groups in their molecules.

As the unsaturated monocarboxylic acid to be reacted with the epoxy resin, there may be mentioned acrylic acid, methacrylic acid or crotonic acid. Further, a monoester of an unsaturated polycarboxylic acid such as a monoester of maleic acid may also be used. These may be used alone or in combination as a mixture.

As the $\alpha,\beta$-monoethylenic unsaturated monomer to be used for diluting the unsaturated polyester resin, there may be mentioned styrene, vinyl toluene, vinyl benzene, vinyl acetae, methacrylic acid, methylmethacrylate, acrylic acid, ethyl acrylate, acrylonitrile, methacrylonitrile, ethyleneglycoldimethacrylate, trimethylol propane trimethacrylate, diethyleneglycolbisallyl carbonate, diallylphthalate, 2,5-dichloro-styrene, diallylether, triallyl cyanurate, 4-vinylcyclo hexanonmonoepoxide, vinylpyrrolidone or triallylphosphate. These monomers may be used alone or in combination as a mixture.

These unsaturated polyester resins are usually hardened by a curing catalyst such as methylethyl ketone peroxide, t-butyl peroxy butalate, t-butyl peroxybenzoate, t-butyl peroxy laurate, t-butyl peroxy-2-ethylhexanoate, t-butyl peroxy pivalate, t-butyl peroxy acetate, t-butyl peroxy isobutylate, t-butylhydroperoxide, cumenehydroperoxide, diisopropylbenzenehydroperoxide, paramethane hydroperoxide or 2,5-dimethyl-2,5-dihydroperoxyhexane. The amount of the curing catalyst is usually from 0.1 to 5 parts by weight per 100 parts by weight of the unsaturated polyester resin (including the $\alpha,\beta$-monoethylenic unsaturated monomer).

In the present invention, it is preferred to incoporate glass flakes having a thickness of from 0.5 to 5 microns, preferably from 1 to 3 microns and a size of from 100 to 400 microns preferably from 150 to 300 microns into the epoxy resin coating or unsaturated polyester resin coating in the intermediate synthetic resin coating.

For the corrosion resistance and physical properties of the coating layer, it is preferred to incorporate the glass flakes in an amount of from 10 to 100 parts by weight, more preferably from 20 to 70 parts by weight, per 100 parts of the epoxy resin or unsaturated polyester resin.

On the other hand, the fluorine-containing copolymer to be used as the top coating in the anticorrosive coating process of the present invention comprises, as essential component, a fluoroolefin, a cyclohexylvinyl ether, an alkylvinyl ether and a hydroxyalkylvinyl ether in amounts of from 40 to 60 molar %, from to 5 to 45 molar %, from 5 to 45 molar % and from 3 to 15 molar %, respectively, preferably from 45 to 55 molar %, from 10 to 30 molar %, from 10 to 35 molar % and from 5 to 13 molar %, respectively.

If the fluoroolefin content is too low, no adequate weatherability is obtainable and there is a difficulty in the production of the copolymer. On the other hand, if the fluorine content is too high, the production of the copolymer will be more difficult. Whereas, if the cyclohexylvinyl ether content is too low the hardness of the coating layer thereby obtained will be too low. If the alkylvinyl ether content is too low, the flexibility of the coating layer thereby obtained will be too low.

For the improvement of the hardness of the coating layer without impairing various desirable properties as the coating base, it is particularly important that the fluorine-containing copolymer to be used for the anticorrosive coating process of the present invention contains the hydroxyalkylvinyl ether in an amount of the abovementioned range. Namely, if the hydroxyalkylvinyl ether content is too high, the solubility of the copolymer will be changed and the copolymer tends to be soluble only in a special solvent such as an alcohol, whereby not only the usefulness as the solvent-coating base is restricted but also the flexibility of the hardened coating layer will be decreased, and moreover the gelation time (pot life) in the presence of a hardener will be shortend, thus substantially impairing the applicability of the coating. Further, if the hydroxyalkylvinyl ether content is too low, no adequate improvement of the hardness will be obtainable, whereby a longer curing time will be required and the solvent resistance or stain resistance of the hardened coating layer will be too low, and further the adhesion to the intermediate synthetic resin coating layer will be impaired.

As the fluoroolefin to be used as a component of the fluorine-containing copolymer, a perhaloolefin, especially chlorotrifluoroethylene or tetrafluoroethylene, is preferably used. As the alkylvinyl ether, an alkylvinyl ether containing a straight chain or branched chain alkyl group having 2 to 8 carbon atoms, especially the one having an alkyl group of 2 to 4 carbon atoms, is preferably used. The fluoroolefins and the alkylvinyl ethers may be respectively used alone or in combination as their mixtures.

The abovementioned fluorine-containing copolymer may contain, in addition to the abovementioned four essential components, other comonomer units in an amount not exceeding 30 molar %. As such comonomers, there may be used olefins such as ethylene, propylene and isobutylene, haloolefins such as vinyl chloride and vinylidene chloride, unsaturated carboxyrates such as methylmethacrylate, vinyl carboxylate such as vinyl acetate and vinyl n-butyrate.

As the abovementioned fluorine-containing copolymer, it is preferred to use those having an intrinsic viscosity of from 0.05 to 2.0 dl/g, particularly from 0.07 to 0.8 dl/g as measured in tetrahydrofurane at 30° C. If the viscosity is too low, the mechanical strength will be too low, whereas if the viscosity is too high, the applicability will be impaired since it will then be required to lower the concentration of the solution to bring the viscosity to a level suitable for use as a solvent-type coating.

The abovementioned fluorine-containing copolymer may be prepared by subjecting a mixture of predetermined proportions of the monomers to a copolymerization reaction in the presence or absence of a polymerization medium and with use of a polymerization initiator such as a water-soluble initiator or an oil-soluble initiator, or a polymerization initiating source such as an ionizing radiation.

When the fluorine-containing copolymer thus obtained used as a top coating, various solvents can be used. For instance, there may be mentioned an aromatic hydrocarbon such as xylene or toluene, an alcohol such as n-butanol, an ester such as butyl acetate, a ketone such as methylisobutyl ketone, and a glycol ether such as ethylene glycol monoethyl ether. Further, commercially available various thinners may also be used.

The mixing of the copolymer with the solvent can be conducted by means of various apparatus commonly used in the preparation of the coatings, such as a ball mill, a paint shaker, a sand mil, a jet mil, triple roll mill or kneader. At this stage, an organic pigment, an inorganic pigment (including a calcined pigment, an extender pigment and a metal pigment), a dispersion stabilizer, a viscosity controlling agent, a leveling agent, an anti-gelling agent or an ultra-violet absorbing agent may be incorporated.

According to the coating process of the present invention, the fluorine-containing copolymer solution or the dispersion obtained by dispersing the pigment, etc., thus obtained, will be comined with a polyisocyanate at the time of the application of the coating.

The polyisocyanate is a polyfunctional isocyanate having at least two isocyanate groups in its molecule, and any one of the aforementioned polyisocyanate may be used without any problems.

Among the afore-mentioned polyisocyanates, particularly useful are non-yellowing isocyanates such as hexamethylenediisocyanate and isophoronediisocyanate and their adducts.

The fluorine-containing copolymer and the polyisocyanate are mixed in such a ratio that the hydroxy groups in the fluorine-containing copolymer/the isocyanate groups in the polyisocyanate is within the range of from 1/1.3 to 1/0.5 (equivalent ratio).

Further, to facilitate the reaction between the fluorine-containing copolymer and the polyisocyanate, a conventional catalyst such as dibutyl tin dilaurate may be added.

In the anticorrosive coating process of the present invention, the abovementioned zinc-rich paint or epoxy resin primer coating is applied by a conventional manner with use of a brush, a roller, an air spray or an airless spray onto the steel surface which has been adequately cleaned by sand blasting or shot blasting.

In the present invention, the dried primer coating layer has a thickness of from 10 to 150 microns, preferably from 15 to 75 microns. If the thickness of the coating is less than 10 microns, no adequate anticorrosive property is obtainable. On the other hand, if the thickness of the coating exceeds 150 microns, it is likely that the coagulation breakage takes place at the interior of the dried coating layer of the primer coating, particularly zinc-rich paint. Accordingly, the coating layer tends to be readily peeled by the slight shocks, mechanical stress or thermal shocks.

Onto the primer coating layer formed by the air-drying of the above primer coating, the abovementioned synthetic resin coating will then be applied by a brush, a spray coating machine, a roller coating machine, etc., in a dried layer thickness of from 25 to 300 microns, followed by air-drying. Usually, the synthetic resin coating layer will be formed in about 1 to 7 days.

Then, onto the synthetic resin coating layer, the abovementioned top coating comprising the abovementioned fluorine-containing copolymer and the polyisocyanate, will be applied by a brush, a spray coating machine, a roller coating machine, etc. to have a dried layer thickness of from 10 to 100 microns, followed by the air-drying for finishing. The coating layer thus obtained according to the process of the present invention has a long lasting corrosion preventing property, long lasting weatherability and superior adhesion and recoatability.

Now, the present invention will be described in further detail with reference to Examples. In the following, "parts" and "%" mean "parts by weight" and "% by weight", respectively. Firstly, various coating materials having the following compositions were prepared.

PREPARATION OF PRIMER COATINGS

Composition 1

An aqueous solution of potassium silicate (solid content of 40%): 30 parts
Zinc dust: 70 parts

Composition 2

An ethyl silicate solution: 25 parts
Zinc dust: 75 parts
The ethyl silicate solution used was the one known by the trade name Colcote#40 (an alcohol solution having a solid content of 40%; a mixture of condensation products of straight chain and branched chain tetraethylortho silicates having an average condensation degree from 4 to 5) manufactured by Nippon Colcote Co.

Composition 3

Main component
Epoxy resin: 6 parts
Xylol: 10 parts
Methylisobutyl ketone: 9 parts
Zinc dust: 65 parts
Hardeners
Polyamide resin: 4 parts
Xylol: 4 parts
Isobutanol: 2 parts
The above epoxy resin was the one known by the trade name Epikote #1001 (epoxy equivalent of from 450 to 520) manufactured by Shell Chemical Co., Ltd., and the polyamide resin is the one known by the trade name Tohmide #210 (amine value of 95±5) manufactured by Fuji Chemical Industry Co., Ltd.

The above Compositions 1 to 3 represent examples of the Compositions of zinc-rich paint. The zinc dust or the zinc dust and the hardener are to be mixed at the time of the application.

Composition 4

Main component
Epoxy resin (Epikote #1001): 33 parts
Red iron oxide: 6.5 parts
Talc: 40 parts
Precipitated barium sulfate: 6 parts
Xylol: 15 parts
Isobutanol: 5 parts
As the hardener, a polyamide resin solution (known by the trade name Sunmide 150, manufactured by Sanwa Chemical Industry Co., Ltd.; a solution containing 37% of non-volatile contents in a solvent mixture of xylol and isobutanol) was used.

Composition 5

Main component
Epoxy resin (Epikote #1001): 31 parts
Red iron oxide: 4 parts
Talc: 40 parts
Red lead: 10 parts
Xylol: 10 parts
Methylisobutyl ketone: 5 parts
The same hardener as used in Composition 4 was used.

In the case of the above Compositions 4 and 5, the main components and the respective hardeners were mixed in a weight ratio of 70:30 immediately prior to the application.

PREPARATION OF SYNTHETIC RESIN COATINGS

Composition 6

Main component
Bisphenol-type epoxy resin (known by the trade name Epikote #828, manufactured by Shell Chemical Co., Ltd.; epoxy equivalent of from 184 to 194): 25 parts
Titanium dioxide: 20 parts
Talc: 15 parts
Precipitated barium sulfate: 15 parts
Precipitation preventing agent (organic bentonite): 2 parts
Methylisobutyl ketone: 13 parts
Xylol: 10 parts
The above Composition was kneaded by rollers to obtain the main component.
Hardener
Polyamide resin (known by the trade name Tohmide #245, manufactured by Fuji Chemical Industry Co., Ltd.; active hydrogen equivalent of 90): 60 parts
Isobutanol: 40 parts
The above Composition was mixed by a disperser to obtain the hardener.

Immediately prior to the application, 80 parts of the main component was mixed with 20 parts of the hardener to obtain the coating Composition 6.

Composition 7

Soybean oil-modified medium oil alkyd resin (oil length of 50%; acid value of 5): 15 parts
Chlorinated rubber: 15 parts
Chlorinated paraffin 40%: 7 parts
Titanium dioxide: 15 parts
Drier: 2 parts
Antiskinning agent: 0.5 part
Precipitation preventing agent: 1 part
Xylol: 44.5 parts Composition 8

Acrylic resin (known by the trade name Acrydic-169, manufactured by Dainippon Ink & Chemicals Inc., non-volatile content of 50%): 40 parts
Titanium dioxide: 20 parts
Precipitation preventing agent: 1 part
Xylol: 39 parts Composition 9

Vinyl chloride resin (known by the trade name VYHH, manufactured by Union Carbide Co.): 20 parts
Dibutylphthalate (DBP): 9 parts
Titanium dioxide: 10 parts
Precipitation preventing agent: 1 part
Methylisobutyl ketone: 30 parts
Xylol: 20 parts
Butyl acetate: 10 parts Composition 10

Phenol resin (known by the trade name Hitanol 1131, manufactured by Hitachi Chemical Industry Co., Ltd.): 20 parts
Soybean oil-modified medium oil alkyd resin (the same as the one used in Composition 7): 15 parts
Toluol: 20 parts
Ethyl acetate: 15 parts
Titanium dioxide: 30 parts Composition 11

Main component
Polyester resin (known by the trade name Desmophen 1100, manufactured by Bayer AG): 14.1 parts
Polyester resin (known by the trade name Desmophen 800, manufactured by Bayer AG): 14.1 parts
Titanium dioxide: 10 parts
Xylol: 6 parts
Ethyl acetate: 6 parts
Butyl acetate: 6 parts
Ethylene glycol monoethyl ether acetate: 4.8 parts
To the main component, 39 parts of the polyisocyanate (known by the trade name Mitec GP 101A, manufactured by Mitsubishi Chemical Industry Co., Ltd., non-volatile content of 75%) was mixed as a hardener at the time of the application of the coating.

Composition 12

| Main component | |
|---|---|
| Isophthalic acid unsaturated polyester resin (known by the trade name Rigolac 150 HR, manufactured by Showa High Polymer Co., Ltd.) | 37 parts |
| Organic bentonite (known by the trade name Bentone #34, manufactured by National Lead Co.) | 2.0 parts |
| Styrene | 35.5 parts |
| Cobalt naphthenate (containing 6% of metal cobalt) | 0.5 part |
| Glass flakes (known by the trade name CF-150, manfactured by Nippon Glass Fiber Co., Ltd.; average size of from 150–200μ; average thickness of from 3–5μ) | 15 parts |
| Talc | 5 parts |
| Titanium dioxide | 5 parts |
| | 100 parts |

Curing Catalyst

Methylethyl ketone peroxide: 0.1 part
Cumenhydroperoxide: 0.3 part

The main component of the above Composition 12 was prepared by mixing the unsaturated polyester resin and the organic bentonite, kneading the mixture by means of rollers and then adding other ingredients, followed by mixing by a disperser. The curing catalyst was incorporated immediately prior to the application of the coating.

PREPARATION OF THE TOP COATINGS

Composition 13

100 Parts of a fluorine-containing four-component copolymer comprising chlorotrifluoroethylene, cyclohexylvinyl ether, ethylvinyl ether and hydroxybutylvinyl ether units in a ratio of 51.2 molar %, 17.1 molar %, 22.5 molar % and 9.1 molar %, respectively, and having an intrinsic viscosity (in tetrahydrofuran at 30° C.) ([η]) of 0.21 dl/g and a glass transition temperature (measured by DSC at a temperature raise rate of 10° C./min.) (Tg) of 45° C., was dissolved in a solvent mixture comprising 40 parts of xylene and 120 parts of methylisobutyl ketone, and then 42 parts of titanium oxide was added. The mixture was kneaded in a pot mill for 24 hours to obtain a main components for the top coating.

Immediately prior to the application of the coating, a hardener composed of 8 parts by hexamethylenediisocyanate and $15\times10^{-7}$ parts of dibutyl tin-dilaurate, was mixed with the above main component to obtain a top coating (Composition 13).

Composition 14

A top coating (Composition 14) was prepared in the same manner as in the preparation of Composition 13 with use of a fluorine-containing four component copolymer comprising tetrafluoroethylene, cyclohexylvinyl ether, ethylvinyl ether and hydroxybutylvinyl ether units in a ratio of 50.8 molar %, 16.9 molar %, 22.8 molar % and 9.5 molar %, respectively, and having an intrinsic viscosity [η] of 0.23 dl/g and a glass transition temperature (Tg) of 27° C.

EXAMPLES 1 to 8

A mild steel sheet (JIS G-3141) of 150×50×1.6 mm was subjected to shot blasting to completely remove the mill scale. rusts and oil stain. Then, in accordance with the coating system as identified in Table 1, the primer coating was firstly applied thereon by air spray to form a coating layer having a dried layer thickness of 35±5 microns and dried at 20° C. in a relative humidity of 75% for 7 days, whereby a primer coating layer was obtained.

Then, the synthetic resin coating was applied thereon by air spraying to form a layer having a dried layer thickness of 100±10 microns and then dried at 20° C. in a relative humidity of 75% for 7 days, whereby a synthetic resin coating layer was obtained. Further, the top coating was applied thereon by air spraying to form a layer having a dried layer thickness of 50±10 microns and dried at 20° C. in the relative humidity of 75% for 7 days.

Each test piece thereby obtained was subjected to the comparative test which will be described hereinafter.

TABLE 1

| | Coating Systems of the Examples | | |
|---|---|---|---|
| | Primer coating | Synthetic resin coating | Top coating |
| Example 1 | Composition 1 | Composition 6 | Composition 13 |
| Example 2 | Composition 2 | Composition 7 | Composition 13 |
| Example 3 | Composition 3 | Composition 8 | Composition 14 |
| Example 4 | Composition 2 | Composition 9 | Composition 14 |
| Example 5 | Composition 2 | Composition 10 | Composition 13 |
| Example 6 | Composition 3 | Composition 11 | Composition 14 |
| Example 7 | Composition 4 | Composition 6 | Composition 13 |
| Example 8 | Composition 5 | Composition 12 | Composition 14 |

COMPARATIVE EXAMPLES 1 to 8

In the same manner as the above Examples, test pieces were prepared in accordance with the coating systems identified in Table 2 and then they were subjected to the comparative tests.

TABLE 2

| | Coating Systems of the Comparative Examples | | |
|---|---|---|---|
| | Primer coating | Synthetic resin coating | Top coating |
| Comparative Example 1 | Composition 1 | Composition 6 | Composition 6 |
| Comparative Example 2 | Composition 2 | Composition 7 | Composition 7 |
| Comparative Example 3 | Composition 3 | Composition 8 | Composition 8 |
| Comparative Example 4 | Composition 2 | Composition 9 | Composition 9 |
| Comparative Example 5 | Composition 2 | Composition 10 | Composition 10 |
| Comparative Example 6 | Composition 3 | Composition 11 | Composition 11 |
| Comparative Example 7 | Composition 4 | Composition 6 | Composition 11 |
| Comparative Example 8 | Composition 5 | Composition 6 | Composition 8 |

The test pieces obtained by Examples 1 to 8 and Comparative Examples 1 to 8 were subjected to salt spray tests for 5000 hours, salt water immersion tests for 5000 hours, sunshine weathering tests for 5000 hours and peeling tests after recoating of the respective top coatings. The results thereby obtained are shown in Table 3. Further, with respect to each isolated top coating, the oxygen permeability was measured and the results thereby obtained are shown in Table 4.

TABLE 3

Comparative Test Results

| | Peeling tests after the recoating of the top coating[1] | Salt spray test[2] | | Salt water immersion tests[3] | | Sunshine weathering test[4] | |
|---|---|---|---|---|---|---|---|
| | | Appearance | tan δ[5] | Appearance | tan δ | Gloss Retention[6] | Appearance |
| Example 1 | O | no change | 0.11 | no change | 0.26 | 89% | no change |
| Example 2 | O | " | 0.18 | " | 0.29 | 91% | " |
| Example 3 | O | " | 0.22 | " | 0.18 | 93% | " |
| Example 4 | O | " | 0.13 | " | 0.11 | 90% | " |
| Example 5 | O | " | 0.19 | " | 0.23 | 92% | " |
| Example 6 | O | " | 0.10 | " | 0.19 | 95% | " |
| Example 7 | O | " | 0.15 | " | 0.17 | 92% | " |
| Example 8 | O | " | 0.12 | " | 0.13 | 93% | " |
| Comparative Example 1 | X | color change | 0.28 | " | 0.35 | 10% | great color change |
| Comparative Example 2 | O | " | 0.76 | blisters | 0.81 | 20% | great color change |
| Comparative Example 3 | Δ | " | 0.82 | " | 0.96 | 40% | slight color change |
| Comparative Example 4 | Δ | " | 0.52 | no change | 0.58 | 20% | color change |
| Comparative Example 5 | X | blisters | 1.31 | blisters | 1.21 | 15% | " |
| Comparative Example 6 | X | color change | 0.71 | no change | 0.79 | 30% | " |
| Comparative Example 7 | X | no change | 0.45 | " | 0.61 | 30% | " |
| Comparative Example 8 | Δ | color change | 0.55 | " | 0.60 | 40% | " |

Notes:
(1)Each of the test pieces prepared in Examples and Comparative Examples was, after being subjected to the sunshine weathering tests for 5000 hours, again coated with the top coating and dried. Then, two parallel cut-lines were made to define a strip having a width of 5 mm and the adhesion of the recoated top coating layer was evaluated by spatula.
O: no peeling, Δ: slightly peeled, X: completely peeled
(2)The salt spraying was conducted for 5000 hours in accordance with the method stipulated in JIS K-5400.
(3)The test pieces were immersed in an aqueous 3 weight % sodium chloride solution at room temperature for 5000 hours.
(4)5000 hours. However, 1000 hours in the case of the Comparative Examples.
(5)This is an electrochemical measuring method which is used for the determination of the anticorrosion property of the coating layer. The measurement was conducted by an alternate current impedance method at 1 KHz and at an input voltage of 0.5 V. The smaller the value, the better the anticorrosive property.
(6)60° - 60° specular gloss retention.

TABLE 4

Oxygen Permeability of the Coating Layers

| Coatings | Resin-types | Oxygen permeability [ml (STP) cm/cm$^2$ sec cm Hg] $\times 10^{10}$ |
|---|---|---|
| Composition 6 | Epoxy resin-type | 0.56 |
| Composition 7 | Chlorinated rubber-type | 1.3 |
| Composition 8 | Acrylic resin-type | 0.71 |
| Composition 9 | Vinylchloride resin-type | 0.41 |
| Composition 10 | Phenol-alkyld resin-type | 0.63 |
| Composition 11 | Polyurethane resin-type | 0.39 |
| Composition 13 | Fluorinated resin-type | 0.13 |
| Composition 14 | Fluorinated resin-type | 0.11 |

Note:
The oxygen permeability was measured by a gas permeability measuring apparatus of Product Science Research Center model (manufactured by Rika Seiki K. K.).

It is apparent from the Comparative test results shown in Table 3 that the test pieces obtained by the coating process of the present invention are far superior to the test pieces of the Comparative Examples in the anticorrosion properties (salt spray tests and salt water immersion tests) and they are also superior in the weatherability (sunshine weathering tests) to the conventional coating layers.

Further, Table 4 indicates that the oxygen permeability of the top coating layers used in the process of the present invention is substantially smaller than the oxygen permeability of the conventional top coating layers. This indicates that the oxygen permeability which constitutes a major corrosion factor is substantially reduced by the process of the present invention and it is thereby possible to substantially improve the anticorrosive properties of the coating layer.

We claim:

1. An anticorrosive coating process which comprises:
(i) a step of applying on a substrate a zinc-rich paint or an epoxy resin primer coating, followed by air-drying,
(ii) a step of applying thereon an intermediate synthetic resin coating, followed by air-drying, and
(iii) a step of applying thereon a top coating comprising (a) a fluorine-containing copolymer composed of from 40 to 60 molar % of a fluoroolefin, from 5 to 45 molar % of cyclohexylvinyl ether, from 5 to 45 molar % of an alkylvinyl ether, from 3 to 15 molar % of a hydroxyalkylvinyl ether and from 0 to 30 molar % of other comonomer and (b) a polyisocyanate, followed by air-drying.

2. The anticorrosive coating process according to claim 1 wherein the intermediate synthetic resin coating is at least one resin selected from the group consisting of an epoxy resin coating, a tar-modified epoxy resin coating, an epoxy-urethane resin coating, a vinyl resin coating, a tar-modified vinyl resin coating, a chlorinated rubber coating, a urethane resin coating, an unsaturated polyester resin coating and an acrylic resin coating.

3. The anticorrosive coating process according to claim 1 wherein the intermediate synthetic resin coating is composed of an unsaturated polyester or epoxy resin, glass flakes and a curing catalyst.

4. The anticorrosive coating process according to claim 1 wherein the fluoroolefin is chlorotrifluoroethylene and/or tetrafluoroethylene.

5. The anticorrosive coating process according to claim 1 wherein the alkylvinyl ether is an alkylvinyl ether containing a straight chain or branched chain alkyl group having from 2 to 8 carbon atoms.

6. The anticorrosive coating process according to claim 1 wherein the hydroxyalkylvinyl ether is hydroxybutylvinyl ether.

* * * * *